US010370825B2

(12) United States Patent
Kondo et al.

(10) Patent No.: US 10,370,825 B2
(45) Date of Patent: Aug. 6, 2019

(54) HYDRAULIC DRIVE SYSTEM OF CONSTRUCTION MACHINE

(71) Applicant: KAWASAKI JUKOGYO KABUSHIKI KAISHA, Kobe-shi, Hyogo (JP)

(72) Inventors: Akihiro Kondo, Nishinomiya (JP); Hideyasu Muraoka, Akashi (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 101 days.

(21) Appl. No.: 15/573,497

(22) PCT Filed: Apr. 28, 2016

(86) PCT No.: PCT/JP2016/002233

§ 371 (c)(1),
(2) Date: Nov. 13, 2017

(87) PCT Pub. No.: WO2016/181635

PCT Pub. Date: Nov. 17, 2016

(65) Prior Publication Data

US 2018/0119391 A1 May 3, 2018

(30) Foreign Application Priority Data

May 11, 2015 (JP) ..... 2015-096280

(51) Int. Cl.
*F15B 11/02* (2006.01)
*E02F 9/22* (2006.01)
(Continued)

(52) U.S. Cl.
CPC ..... *E02F 9/2235* (2013.01); *E02F 3/425* (2013.01); *E02F 9/2004* (2013.01);
(Continued)

(58) Field of Classification Search
CPC ..... E02F 9/2235; E02F 9/2296; E02F 3/425; E02F 9/2292; E02F 3/32; F04B 49/06
See application file for complete search history.

(56) References Cited

U.S. PATENT DOCUMENTS 6,020,651 A * 2/2000 Nakamura ..... E02F 9/2235 123/496
8,924,100 B2 * 12/2014 Imura ..... B60W 10/06 701/50

(Continued)

FOREIGN PATENT DOCUMENTS

JP H11-2144 A 1/1999

OTHER PUBLICATIONS

Aug. 2, 2016 International Search Report issued in International Patent Application No. PCT/JP2016/002233.

*Primary Examiner* — Thomas E Lazo
(74) *Attorney, Agent, or Firm* — Oliff PLC

(57) ABSTRACT

Pump controller: when operation device receives neither first or second operation, outputs standby rotation speed as command rotation speed to engine controller, standby rotation speed being lower than selected reference rotation speed; when operation device receives first operation, changes command rotation speed from standby rotation speed to first target rotation speed in such a manner that as an amount of first operation increases, increasing rate of command rotation speed decreases gradually; when operation device receives second operation, changes command rotation speed from standby rotation speed to second target rotation speed in such a manner that as an amount of second operation increases, increasing rate of command rotation speed increases gradually; and feeds command current to a solenoid proportional valve that outputs secondary pressure to regulator that adjusts tilting angle of a pump, such that a discharge flow rate of the pump is proportional to amount of first and second operation.

6 Claims, 5 Drawing Sheets

(51) Int. Cl.

| | |
|---|---|
| ***F04B 49/06*** | (2006.01) |
| ***E02F 3/42*** | (2006.01) |
| ***E02F 9/20*** | (2006.01) |
| ***F02D 41/30*** | (2006.01) |
| ***F15B 11/028*** | (2006.01) |
| ***F02D 29/04*** | (2006.01) |
| ***F02D 41/02*** | (2006.01) |
| ***F04B 1/29*** | (2006.01) |
| ***F15B 11/17*** | (2006.01) |
| *E02F 3/32* | (2006.01) |
| *F15B 11/08* | (2006.01) |
| *F15B 13/044* | (2006.01) |
| *F02D 31/00* | (2006.01) |

(52) U.S. Cl.

CPC ..... *E02F 9/2246* (2013.01); *E02F 9/2282* (2013.01); *E02F 9/2292* (2013.01); *E02F 9/2296* (2013.01); *F02D 29/04* (2013.01); *F02D 41/0205* (2013.01); *F02D 41/3005* (2013.01); *F04B 1/295* (2013.01); *F04B 49/06* (2013.01); *F15B 11/028* (2013.01); *F15B 11/17* (2013.01); *E02F 3/32* (2013.01); *F02D 31/001* (2013.01); *F02D 2200/101* (2013.01); *F15B 11/08* (2013.01); *F15B 13/0442* (2013.01); *F15B 2211/20523* (2013.01); *F15B 2211/20546* (2013.01); *F15B 2211/20576* (2013.01); *F15B 2211/633* (2013.01); *F15B 2211/6316* (2013.01); *F15B 2211/6346* (2013.01); *F15B 2211/6651* (2013.01); *F15B 2211/6652* (2013.01)

(56) References Cited

U.S. PATENT DOCUMENTS

| | | | | |
|---|---|---|---|---|
| 9,561,788 | B2 * | 2/2017 | Ito | E02F 9/2075 |
| 9,657,654 | B2 * | 5/2017 | Kayane | F02D 29/04 |
| 9,777,750 | B2 * | 10/2017 | Sugano | F15B 11/10 |

* cited by examiner

HYDRAULIC DRIVE SYSTEM OF CONSTRUCTION MACHINE

TECHNICAL FIELD

The present invention relates to a hydraulic drive system of a construction machine.

BACKGROUND ART

Construction machines, such as hydraulic excavators and hydraulic cranes, perform various work by means of a hydraulic drive system. For example, Patent Literature 1 discloses a hydraulic drive system including first and second pumps that supply hydraulic oil to a plurality of actuators and an engine that drives these pumps.

The first and second pumps are variable displacement pumps, and tilting angles of these pumps are adjusted by first and second regulators. A plurality of solenoid proportional valves output secondary pressures to the first and second regulators, and the solenoid proportional valves are controlled by a pump controller.

The engine that drives the first and second pumps includes a fuel injector, and the fuel injector is controlled by an engine controller. The engine controller is connected to a rotation speed selector that receives a selection of a reference rotation speed of the engine (the engine controller is referred to as an "accelerator operation input unit" in Patent Literature 1).

The hydraulic drive system disclosed in Patent Literature 1 is configured such that the engine rotation speed is kept low while the construction machine is performing no work or performing light work, and such that the engine rotation speed increases when an operation device including an operating lever is operated. The operation device is a pilot operation valve that outputs a pilot pressure corresponding to an inclination angle of the operating lever (i.e., outputs a pilot pressure corresponding to the amount of an operation received by the operating lever).

Specifically, first, the pump controller calculates a flow rate control required rotation speed NN and an engine required horsepower PN based on a selected reference rotation speed, a pump discharge pressure, and a pilot pressure outputted from the operation device. The calculated flow rate control required rotation speed NN and the engine required horsepower PN are transmitted from the pump controller to the engine controller. The engine controller calculates a horsepower basis rotation speed NK based on the engine required horsepower PN, and sets a higher rotation speed between the horsepower basis rotation speed NK and the flow rate control required rotation speed NN as a target rotation speed. The engine controller controls the fuel injector, such that the actual rotation speed of the engine is the target rotation speed. For example, when the operation device is not operated, the flow rate control required rotation speed NN is zero. Accordingly, the fuel injector is controlled based on the horsepower basis rotation speed NK.

CITATION LIST

Patent Literature

PTL 1: Japanese Laid-Open Patent Application Publication. No. H11-2144

SUMMARY OF INVENTION

Technical Problem

However, performing the above-described rotation speed calculation by both the pump controller and the engine controller and comparing the calculation results are complex. Therefore, it is desired that a command rotation speed be outputted from the pump controller to the engine controller.

Moreover, in the hydraulic drive system disclosed in Patent Literature 1, the number of pressure meters provided for each operation device is only one. Therefore, regardless of whether the operation device receives a first operation or a second operation, the relationship between the pilot pressure outputted from the operation device and the engine rotation speed is the same. However, for example, in a hydraulic excavator, the load on a boom cylinder when the boom cylinder is moved in the rod-expanding direction is significantly higher than the load when the boom cylinder is moved in the rod-contracting direction. Such difference of the load depending on the moving direction occurs also in the case of moving an arm cylinder and the case of moving a bucket cylinder. Even though the load differs in such a manner, if the relationship between the amount of the first operation and the engine rotation speed is the same as the relationship between the amount of the second operation and the engine rotation speed, then the following problems may occur: the engine torque becomes insufficient; or the engine torque becomes surplus, which causes the engine rotation speed to increase more than necessary.

In view of the above, an object of the present invention is to provide a hydraulic drive system of a construction machine, the hydraulic drive system being capable of outputting a command rotation speed from a pump controller to an engine controller and suitably changing an engine rotation speed in accordance with a load difference that occurs depending on a moving direction of an actuator.

Solution to Problem

In order to solve the above-described problems, a hydraulic drive system of a construction machine according to the present invention includes: an operation device that receives a first operation for moving an actuator in a first direction and receives a second operation for moving the actuator in a second direction, in which a load on the actuator is lower than the load on the actuator moved in the first direction; a variable displacement pump that supplies hydraulic oil to the actuator and that is driven by an engine; a solenoid proportional valve that outputs a secondary pressure corresponding to a command current; a regulator that adjusts a tilting angle of the pump in accordance with the secondary pressure outputted from the solenoid proportional valve; an engine controller that controls a fuel injector of the engine; a rotation speed selector that receives a selection of a reference rotation speed of the engine; and a pump controller that outputs a command rotation speed to the engine controller and feeds the command current to the solenoid proportional valve. The pump controller: when the operation device receives neither the first operation nor the second operation, outputs a standby rotation speed as the command rotation speed, the standby rotation speed being lower than the selected reference rotation speed; when the operation device receives the first operation, changes the command rotation speed from the standby rotation speed to a first target rotation speed lower than or equal to the selected reference rotation speed in such a manner that as an amount of the first operation increases, an increasing rate of the command rotation speed decreases gradually; when the operation device receives the second operation, changes the command rotation speed from the standby rotation speed to a second target rotation speed lower than or equal to the selected reference rotation speed in such a manner that as an amount of the second operation increases, the increasing rate of the command rotation speed increases gradually; and feeds the command current to the solenoid proportional valve, such that a discharge flow rate of the pump is proportional to the amount of the first operation and the amount of the second operation.

According to the above configuration, the command rotation speed is outputted from the pump controller to the engine controller. In a case where the actuator is moved in the first direction, in which the load on the actuator is higher, the command rotation speed increases at an early stage immediately after the first operation is started. As a result, the engine torque is prevented from becoming insufficient relative to the pump absorbing torque. On the other hand, in a case where the actuator is moved in the second direction, in which the load on the actuator is lower, the command rotation speed increases in a delayed manner relative to the second operation. As a result, the engine torque is prevented from becoming surplus to the pump absorbing torque. Therefore, the engine rotation speed can be suitably changed in accordance with a load difference that occurs depending on the moving direction of the actuator.

For example, the actuator may be at least one of a boom cylinder, an arm cylinder, and a bucket cylinder.

The second target rotation speed may be lower than the first target rotation speed. According to this configuration, the command rotation speed being high or low and the load being high or low can be made match with each other.

The pump controller may feed the command current to the solenoid proportional valve, such that a maximum value of the tilting angle of the pump when the amount of the first operation is at its maximum is the same as a maximum value of the tilting angle of the pump when the amount of the second operation is at its maximum. According to this configuration, the pump displacement can be brought to its maximum both when the amount of the first operation becomes its maximum and when the amount of the second operation becomes its maximum.

Advantageous Effects of Invention

The present invention makes it possible to output a command rotation speed from the pump controller to the engine controller and suitably change the engine rotation speed in accordance with a load difference that occurs depending on the moving direction of the actuator.

DESCRIPTION OF EMBODIMENTS

Figure 1:
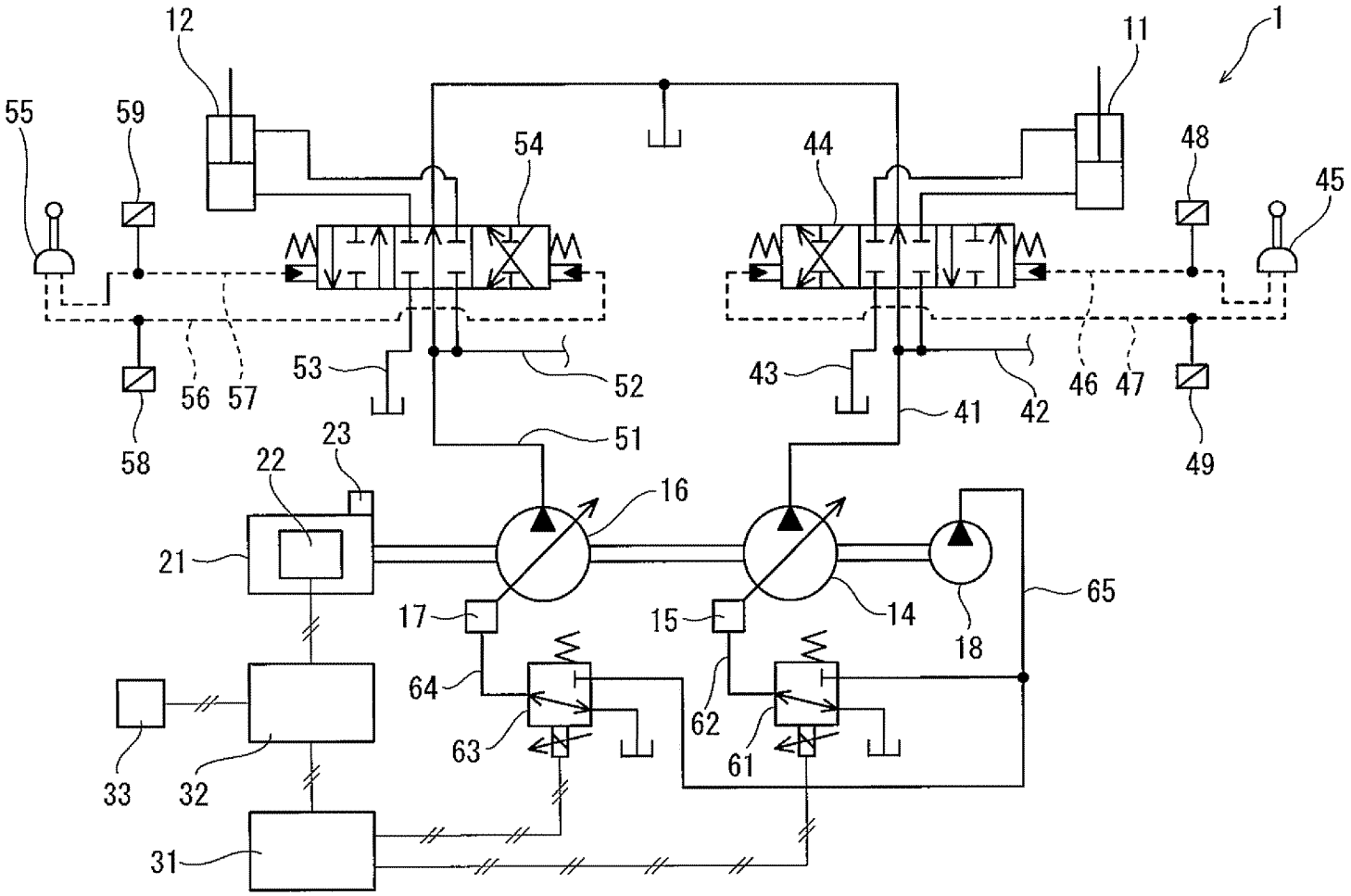
FIG. 1 shows a schematic configuration of a hydraulic drive system according to one embodiment of the present invention.
Figure 2:
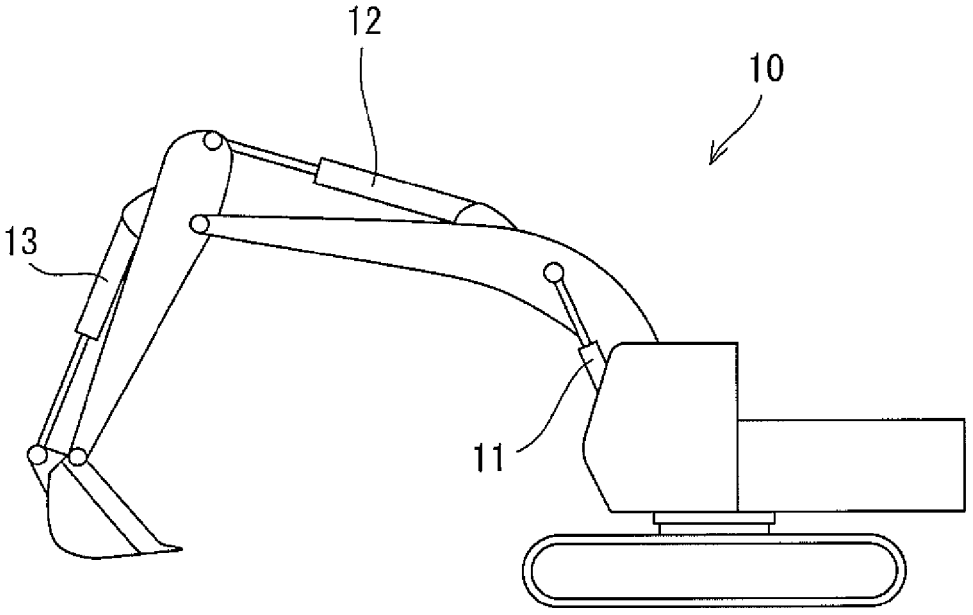
FIG. 2 is a side view of a hydraulic excavator that is one example of a construction machine.

FIG. 1 shows a hydraulic drive system 1 of a construction machine according to one embodiment of the present invention. FIG. 2 shows a construction machine 10, in which the hydraulic drive system 1 is installed. Although the construction machine 10 shown in FIG. 2 is a hydraulic excavator, the present invention is applicable to other construction machines, such as a hydraulic crane.

The hydraulic drive system 1 includes, as hydraulic actuators, a boom cylinder 11, an arm cylinder 12, and a bucket cylinder 13, which are shown in FIG. 2, and also a turning motor and a pair of right and left running motors, which are not shown. As shown in FIG. 1, the hydraulic drive system 1 further includes: a first main pump 14 and a second main pump 16 for supplying hydraulic oil to these actuators; and an engine 21 driving the first main pump 14 and the second main pump 16. It should be noted that, in FIG. 1, the actuators other than the boom cylinder 11 and the arm cylinder 12 are not shown for the purpose of simplifying the drawing.

A first circulation line 41 extends from the first main pump 14 to a tank. A plurality of control valves including a boom control valve 44 and a bucket control valve (the control valves other than the boom control valve 44 are not shown) are disposed on the first circulation line 41. The boom control valve 44 controls supply and discharge of the hydraulic oil to and from the boom cylinder 11, and the other control valves also control the supply and discharge of the hydraulic oil to and from respective actuators. A parallel line 42 branches off from the first circulation line 41. The hydraulic oil discharged from the first main pump 14 is led to all the control valves on the first circulation line 41 through the parallel line 42.

Similarly, a second circulation line 51 extends from the second main pump 16 to the tank. A plurality of control valves including an arm control valve 54 and a turning motor (the control valves other than the arm control valve 54 are not shown) are disposed on the second circulation line 51. The arm control valve 54 controls the supply and discharge of the hydraulic oil to and from the arm cylinder 12, and the other control valves also control the supply and discharge of the hydraulic oil to and from respective actuators. A parallel line 52 branches off from the second circulation line 51. The hydraulic oil discharged from the second main pump 16 is led to all the control valves on the second circulation line 51 through the parallel line 52.

The boom control valve 44 is connected to the boom cylinder 11 by a pair of supply/discharge lines. A tank line 43 is connected to the boom control valve 44. The boom control valve 44 includes a pair of pilot ports. These pilot ports are connected to a boom operation device 45, which is a pilot operation valve, by a pair of pilot lines 46 and 47.

The boom operation device 45 includes an operating lever that receives: a boom raising operation (first operation) for moving the boom cylinder 11 in a boom raising direction (first direction); and a boom lowering operation (second operation) for moving the boom cylinder 11 in a boom lowering direction (second direction). Needless to say, the load is higher when the boom cylinder 11 is moved in the boom raising direction than when the boom cylinder 11 is moved in the boom lowering direction. The boom operation device 45 outputs a pilot pressure corresponding to an inclination angle of the operating lever (i.e., outputs a pilot pressure corresponding to the amount of the boom raising operation or boom lowering operation) to the boom control valve 44. The pilot lines 46 and 47 are provided with pressure meters 48 and 49, respectively, each of which detects a pilot pressure outputted from the boom operation device 45 (i.e., detects the amount a corresponding one of the boom raising operation and the boom lowering operation)

The arm control valve 54 is connected to the arm cylinder 12 by a pair of supply/discharge lines. A tank line 53 is connected to the arm control valve 54. The ami control valve 54 includes a pair of pilot ports. These pilot ports are connected to an arm operation device 55, which is a pilot operation valve, by a pair of pilot lines 56 and 57.

The arm operation device 55 includes an operating lever that receives: an arm crowding operation (first operation) for moving the arm cylinder 12 in an arm crowding direction (first direction); and an arm pushing operation (second operation) for moving the arm cylinder 12 in an arm pushing direction (second direction). In excavating work and soil discharging work, each of which is main work of the excavator, the load when the arm cylinder 12 is moved in the arm crowding direction, i.e., the load of the excavating work, is higher than the load when the arm cylinder 12 is moved in the arm pushing direction, i.e., the load of the soil discharging work. The arm operation device 55 outputs a pilot pressure corresponding to an inclination angle of the operating lever (i.e., outputs a pilot pressure corresponding to the amount of the arm crowding operation or arm pushing operation) to the arm control valve 54. The pilot lines 56 and 57 are provided with pressure meters 58 and 59, respectively, each of which detects a pilot pressure outputted from the arm operation device 55 (i.e., detects the amount of a corresponding one of the arm crowding operation and the arm pushing operation).

Although not illustrated, the other control valves, such as the bucket control valve and turning control valve, are configured in the same manner as the above-described boom control valve 44 and arm control valve 54. Additionally referring to the bucket cylinder 13, the load on the bucket cylinder 13 when the bucket cylinder 13 is moved in a bucket-in direction (first direction) is higher than the load when the bucket cylinder 13 is moved in a bucket-out direction (second direction). The first operation of the bucket cylinder 13 is a bucket-in operation, and the second operation thereof is a bucket-out operation.

Each of the first main pump 14 and the second main pump 16 is a variable displacement pump (a swash plate pump or bent axis pump) whose tilting angle can be changed. The tilting angle of the first main pump 14 is adjusted by a first regulator 15, and the tilting angle of the second main pump 16 is adjusted by a second regulator 17. The discharge flow rate of the first main pump 14 and the discharge flow rate of the second main pump 16 are controlled by electrical positive control.

Specifically, the first regulator 15 is connected to a first solenoid proportional valve 61 by a secondary pressure line 62, and the second regulator 17 is connected to a second solenoid proportional valve 63 by a secondary pressure line 64. The first solenoid proportional valve 61 and the second solenoid proportional valve 63 are connected to a sub pump 18 by a primary pressure line 65. The sub pump 18 is driven by the aforementioned engine 21.

The first regulator 15 adjusts the tilting angle of the first main pump 14 in accordance with a secondary pressure outputted from the first solenoid proportional valve 61, and the second regulator 17 adjusts the tilting angle of the second main pump 16 in accordance with a secondary pressure outputted from the second solenoid proportional valve 63. Each of the first solenoid proportional valve 61 and the second solenoid proportional valve 63 outputs the secondary pressure corresponding to a command current. In the present embodiment, each of the first solenoid proportional valve 61 and the second solenoid proportional valve 63 is a direct proportional valve (normally closed valve), that is, the secondary pressure increases in accordance with increase in the command current. The command current is fed to each of the first solenoid proportional valve 61 and the second solenoid proportional valve 63 from a pump controller 31.

Each of the first regulator 15 and the second regulator 17 increases the tilting angle of the main pump (14 or 16) in accordance with increase in the secondary pressure outputted from the solenoid proportional valve (61 or 63), and decreases the tilting angle of the main pump in accordance with decrease in the secondary pressure outputted from the solenoid proportional valve. When the tilting angle of the main pump increases, the pump displacement increases and the discharge flow rate increases, accordingly. When the tilting angle of the main pump decreases, the pump displacement decreases and the discharge flow rate decreases, accordingly.

Figure 3:
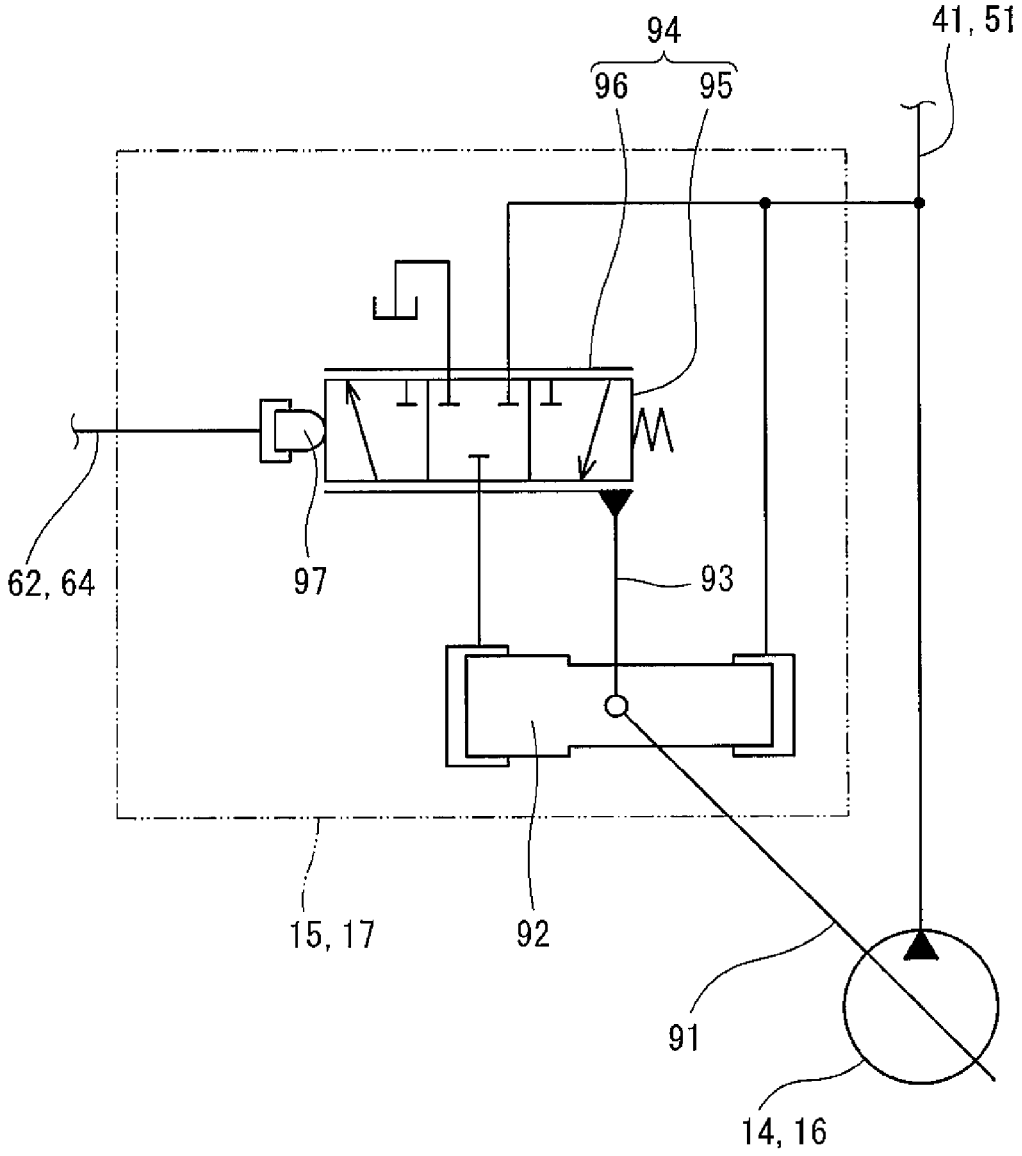
FIG. 3 shows a schematic configuration of a regulator.

To be more specific, the first regulator 15 and the second regulator 17 have the same configuration as shown in FIG. 3. For this reason, hereinafter, the configuration of the first regulator 15 is described as a representative example.

The first regulator 15 includes: a servo piston 92, which changes the tilting angle of the first main pump 14; and a switching valve 94, which operates the servo piston 92. For example, in a case where the first main pump 14 is a awash plate pump, the servo piston 92 is coupled to a swash plate 91 of the first main pump 14 in such a manner that the servo piston 92 is slidable in its axial direction. The discharge pressure of the first main pump 14 is applied to the smaller-diameter side of the servo piston 92, and a control pressure outputted from the switching valve 94 is applied to the larger-diameter side of the servo piston 92. The switching valve 94 includes: a sleeve 96 coupled to the servo piston 92 by a lever 93 in such a manner that the sleeve 96 is slidable in the axial direction of the servo piston 92; and a spool 95 accommodated in the sleeve 96. The position of the sleeve 96 relative to the spool 95 is adjusted such that force (pressure×pressure receiving area of the servo piston) applied to one side of the servo piston 92 and force (pressure×pressure receiving area of the servo piston) applied to the other side of the serve piston 92 are in balance.

The spool 95 of the switching valve 94 is driven by a piston 97. The piston 97 receives a secondary pressure outputted from the first solenoid proportional valve 61. When the secondary pressure increases, the piston 97 moves the spool 95 in a flow rate increasing direction (i.e., in such a direction as to increase the discharge flow rate of the first main pump 14). When the secondary pressure decreases, the piston 97 moves the spool 95 in a flow rate decreasing direction (i.e., in such a direction as to decrease the discharge flow rate of the first main pump 14).

Figure 4:
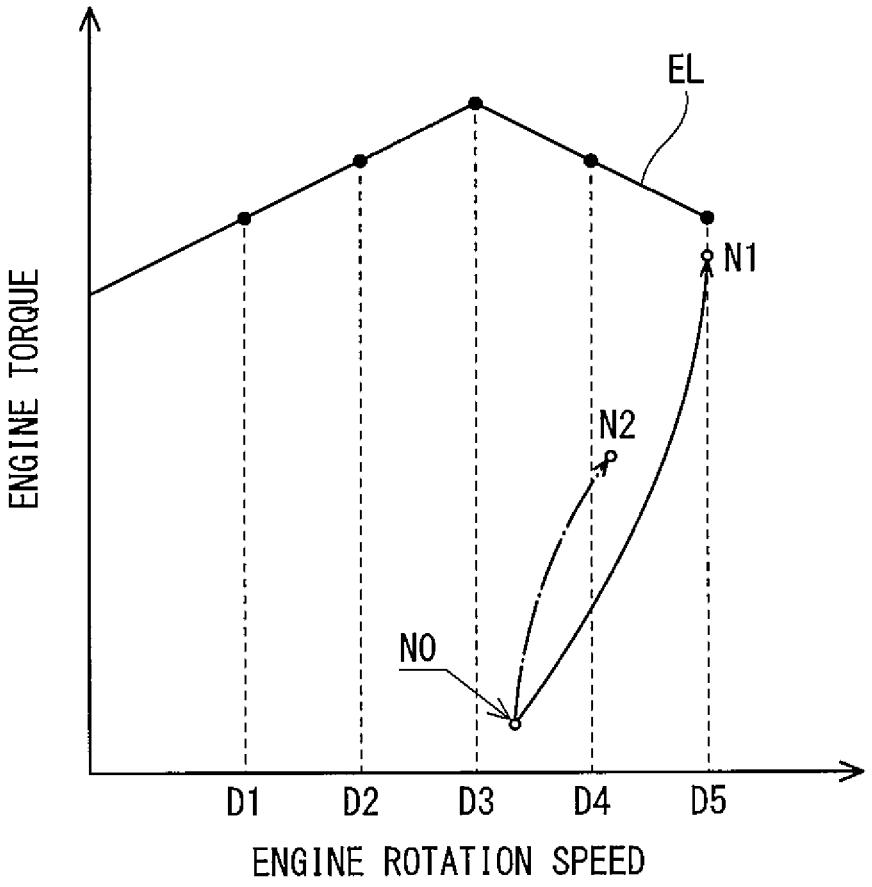
FIG. 4 is a graph showing a relationship between an engine rotation speed and an engine torque.

Returning to FIG. 1, the engine 21 driving the pumps 14, 16, and 18 includes a fuel injector 22. The engine 21 is also provided with a rotation speed meter 23, which detects the rotation speed of the engine 21. The fuel injector 22 is controlled by an engine controller 32. The engine controller 32 is connected to a rotation speed selector 33, which receives a selection of a reference rotation speed D of the engine 21, the selection being made by an operator. FIG. 4 illustratively shows five cases in which the reference rotation speed D ranges from D1 to D5. In FIG. 4, a solid line EL indicates the maximum torque of the engine.

A command rotation speed is outputted from the aforementioned pump controller 31 to the engine controller 32. The loads on the boom cylinder 11, the arm cylinder 12, and the bucket cylinder 13, which are hydraulic cylinders, are such that the load on each hydraulic cylinder differs depending on its moving direction. Therefore, in the present embodiment, control of suitably changing the engine rotation speed is performed. The control is described below.

Figure 5A:
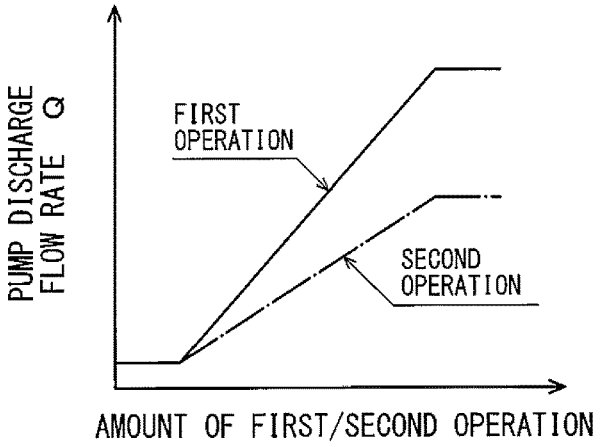
FIG. 5A is a discharge flow rate map that defines a relationship between a pump discharge flow rate and the amount of first/second operation.
Figure 5B:
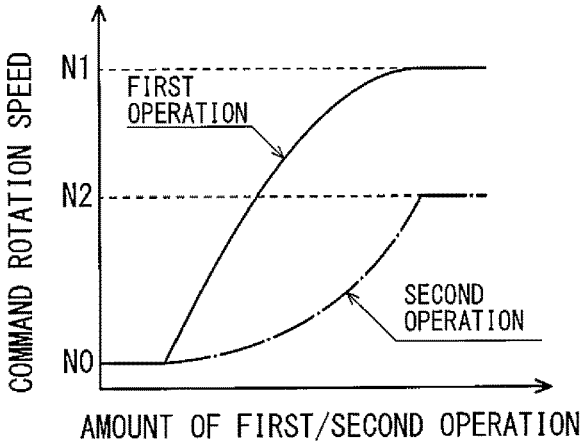
FIG. 5B is a rotation speed map that defines a relationship between a command rotation speed and the amount of first/second operation.

Specifically, for each of the boom cylinder 11, the arm cylinder 12, and the bucket cylinder 13, a discharge flow rate map shown in FIG. 5A and a rotation speed map shown in FIG. 5B are prestored in the pump controller 31. It should be noted that the discharge flow rate map and the rotation speed map have different characteristics for each cylinder. As mentioned above, for the boom cylinder 11, the boom raising operation is the first operation, and the boom lowering operation is the second operation. For the arm cylinder 12, the arm crowding operation is the first operation, and the arm pushing operation is the second operation. For the bucket cylinder 13, the bucket-in operation is the first operation, and the bucket-out operation is the second operation.

As shown in FIG. 5A, in the discharge flow rate map for each cylinder, the pump discharge flow rate Q is set such that it is proportional to the amount of the first operation and the amount of the second operation, i.e., such that the pump discharge flow rate Q increases in a linear manner in accordance with increase in the amount of the first operation and increase in the amount of the second operation. It should be noted that the pump discharge flow rate Q when the first operation is performed is higher than the pump discharge flow rate Q when the second operation is performed.

As shown in FIG. 5B, in the rotation speed map for each cylinder, a convex curve is set such that when each operation device receives the first operation, the command rotation speed changes from a standby rotation speed N0 to a first target rotation speed N1 in such a manner that as the amount of the first operation increases, the increasing rate of the command rotation speed decreases gradually. Also, in the rotation speed map, a concave curve is set such that when each operation device receives the second operation, the command rotation speed changes from the standby rotation speed N0 to a second target rotation speed N2 in such a manner that as the amount of the second operation increases, the increasing rate of the command rotation speed increases gradually. The standby rotation speed N0 is lower than the reference rotation speed D selected by the rotation speed selector 33, and the first target rotation speed N1 and the second target rotation speed N2 are lower than or equal to the selected reference rotation speed D.

For example, the standby rotation speed N0 is calculated by multiplying the selected reference rotation speed D by a coefficient less than 1 (e.g., 0.8 to 0.9). Alternatively, the standby rotation speed N0 may be calculated by subtracting a predetermined rotation speed (e.g., 100 to 300 rpm) from the selected reference rotation speed D.

Figure 5C:
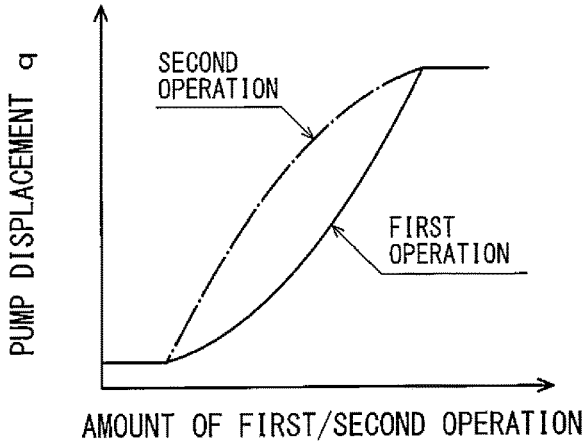
FIG. 5C is a graph showing a relationship between a pump displacement and the amount of first/second operation.

The pump discharge flow rate Q is the product of a pump displacement q and an engine rotation speed N ($Q=q\times N$). Accordingly, the pump controller 31 calculates the pump displacement q for the amount of the first operation and the pump displacement q for the amount of the second operation based on the discharge flow rate map shown in FIG. 5A and the rotation speed map shown in FIG. 5B. As shown in FIG. 5C, conversely to the command rotation speed shown in FIG. 5B, when the first operation is performed, the pump displacement q draws a concave curve, and when the second operation is performed, the pump displacement q draws a convex curve. The pump controller 31 further calculates such a command current as to obtain a tilting angle of the main pump (14 or 16), the tilting angle achieving the pump displacement q, and feeds the calculated command current to the solenoid proportional valve (61 or 63).

The first target rotation speed N1 may be lower than the selected reference rotation speed D. However, desirably, the first target rotation speed N1 is equal to the reference rotation speed D in order for the maximum engine rotation speed at high load to be equal to the reference rotation speed D. Although the second target rotation speed N2 may be equal to the reference rotation speed D, the second target rotation speed N2 is desirably lower than the first target rotation speed N1, because with such setting, the command rotation speed being high or low and the load being high or low can be made match with each other.

Desirably, the pump controller 31 feeds the command current to the solenoid proportional valve (61 or 63), such that the maximum value of the tilting angle of the main pump (14 or 16) when the amount of the first operation is at its maximum is the same as the maximum value of the tilting angle of the main pump when the amount of the second operation is at its maximum. The reason for this is that the pump displacement q can be brought to its maximum both when the amount of the first operation becomes its maximum and when the amount of the second operation becomes its maximum.

While none of the boom operation device 45, the arm operation device 55, and a bucket operation device (not shown) are receiving the first or second operation, the pump controller 31 outputs the standby rotation speed N0 to the engine controller 32 as a command rotation speed. Of course, even while none of the boom operation device 45, the arm operation device 55, and the bucket operation device (not shown) are receiving the first or second operation, if any of a turning operation device, a right-running operation device, and a left-running operation device (which are not shown) is operated, the pump controller 31 outputs a command rotation speed corresponding to the load to the engine controller 32. Hereinafter, control when the boom operation device 45 is operated and control when the arm operation device 55 is operated are described in detail.

(When Boom Operation Device is Operated)

When the boom operation device 45 receives a boom raising operation (first operation), the pump controller 31 changes the command rotation speed outputted to the engine controller 32, such that the command rotation speed transitions along the convex curve shown in FIG. 5B. The engine controller 32 controls the fuel injector 22, such that the actual engine rotation speed measured by the rotation speed meter 23 is the command rotation speed. Also, the pump controller 31 feeds a command current to the first solenoid proportional valve 61, such that the pump displacement q (tilting angle) of the first main pump 14 transitions along the concave curve shown in FIG. 5C. As a result, the engine torque changes as indicated by a solid line shown in FIG. 4.

On the other hand, when the boom operation device 45 receives a boom lowering operation (second operation), the pump controller 31 changes the command rotation speed outputted to the engine controller 32, such that the command rotation speed transitions along the concave curve shown in FIG. 5B. The engine controller 32 controls the fuel injector 22, such that the actual engine rotation speed measured by the rotation speed meter 23 is the command rotation speed. Also, the pump controller 31 feeds a command current to the first solenoid proportional valve 61, such that the pump displacement q (tilting angle) of the first main pump 14 transitions along the convex curve shown in FIG. 5C. As a result, the engine torque changes as indicated by a one-dot chain line shown in FIG. 4.

It should be noted that also when the bucket operation device, which is not shown, receives a bucket-in operation (first operation) or a bucket-out operation, the same control as that performed when the boom operation device is operated is performed.

(When Arm Operation Device is Operated)

When the arm operation device 55 receives an arm crowding operation (first operation), the pump controller 31 changes the command rotation speed outputted to the engine controller 32, such that the command rotation speed transitions along the convex curve shown in FIG. 5B. The engine controller 32 controls the fuel injector 22, such that the actual engine rotation speed measured by the rotation speed meter 23 is the command rotation speed. Also, the pump controller 31 feeds a command current to the second solenoid proportional valve 63, such that the pump displacement q (tilting angle) of the second main pump 16 transitions along the concave curve shown in FIG. 5C. As a result, the engine torque changes as indicated by the solid line shown in FIG. 4. It should be noted that, as mentioned above, the discharge flow rate map and the rotation speed map for the arm cylinder 12 have different characteristics from those of the discharge flow rate map and the rotation speed map for the boom cylinder 11.

On the other hand, when the arm operation device 55 receives an arm pushing operation (second operation), the pump controller 31 changes the command rotation speed outputted to the engine controller 32, such that the command rotation speed transitions along the concave curve shown in FIG. 5B. The engine controller 32 controls the fuel injector 22, such that the actual engine rotation speed measured by the rotation speed meter 23 is the command rotation speed. Also, the pump controller 31 feeds a command current to the second solenoid proportional valve 63, such that the pump displacement q (tilting angle) of the second main pump 16 transitions along the convex curve shown in FIG. 5C. As a result, the engine torque changes as indicated by the one-dot chain line shown in FIG. 4.

It should be noted that when a plurality of operation devices are operated at the same time, control taking account of the actuator with the highest load, or control taking account of the total load, may be performed for each of the first main pump 14 and the second main pump 16.

As described above, in the hydraulic drive system 1 according to the present embodiment, the command rotation speed is outputted from the pump controller 31 to the engine controller 32. In a case where any of the boom cylinder 11, the arm cylinder 12, and the bucket cylinder 13 is moved in the first direction, in which the load on the cylinder is higher, the command rotation speed increases at an early stage immediately after the first operation is started. As a result, the engine torque is prevented from becoming insufficient relative to the pump absorbing torque. On the other hand, in a case where any of the boom cylinder 11, the arm cylinder 12, and the bucket cylinder 13 is moved in the second direction, in which the load on the cylinder is lower, the command rotation speed increases in a delayed manner relative to the second operation. As a result, the engine torque is prevented from becoming surplus to the pump absorbing torque, and also, the pump displacement q of the first main pump 14 or the second main pump 16 increases at an early stage, which makes it possible to use the first main pump 14 or the second main pump 16 with high efficiency. Therefore, the engine rotation speed can be suitably changed in accordance with a load difference that occurs depending on the moving direction of the actuator.

<Variations>

The present invention is not limited to the above-described embodiment. Various modifications can be made without departing from the spirit of the present invention.

For example, the first and second solenoid proportional valves 61 and 63 may be inverse proportional valves (normally open valves), that is, the secondary pressure decreases in accordance with increase in the command current. In this case, the first and second regulators 15 and 17 may be configured to increase the tilting angles of the first and second main pumps 14 and 16 (i.e., increase the pump capacities) in accordance with decrease in the secondary pressures outputted from the solenoid proportional valves 61 and 63.

In the above-described embodiment, the boom operation device 45 and the arm operation device 55 are pilot operation valves. However, as an alternative, the boom operation device 45 and the arm operation device 55 may each be an electrical joystick that outputs an electrical operation signal in accordance with an inclination angle of the operating lever. In this case, the pair of pilot ports of each of the boom control valve 44 and the arm control valve 54 may be connected to a pair of solenoid proportional valves by the pilot lines (46, 47 or 56, 57).

The second main pump 16 is not essential, and the hydraulic oil may be supplied to all the actuators from the first main pump 14.

The actuators of the present invention need not be the boom cylinder 11, the arm cylinder 12, and the bucket cylinder 13, respectively, but may be at least one of the boom cylinder 11, the arm cylinder 12, and the bucket cylinder 13. Alternatively, depending on the type of the construction machine, the actuator of the present invention may be different from a hydraulic cylinder. For example, the actuator of the present invention may be a hydraulic motor whose load differs depending on its moving direction, that is, the load when the hydraulic motor is moved in one direction is different from the load when the hydraulic motor is moved in the other direction.

REFERENCE SIGNS LIST

1 hydraulic drive system
10 construction machine
11 boom cylinder (actuator)
12 arm cylinder (actuator)
13 bucket cylinder (actuator)
14, 16 main pump
15, 17 regulator
21 engine
22 fuel injector
31 pump controller
32 engine controller
33 rotation speed selector
45, 55 operation device
61, 63 solenoid proportional valve

The invention claimed is:

1. A hydraulic drive system of a construction machine, the hydraulic drive system comprising:

an operation device that receives a first operation for moving an actuator in a first direction and receives a second operation for moving the actuator in a second direction, in which a load on the actuator is lower than the load on the actuator moved in the first direction;

a variable displacement pump that supplies hydraulic oil to the actuator and that is driven by an engine;

a solenoid proportional valve that outputs a secondary pressure corresponding to a command current;

a regulator that adjusts a tilting angle of the pump in accordance with the secondary pressure outputted from the solenoid proportional valve;

an engine controller that controls a fuel injector of the engine;

a rotation speed selector that receives a selection of a reference rotation speed of the engine; and a pump controller that outputs a command rotation speed to the engine controller and feeds the command current to the solenoid proportional valve, wherein the pump controller:

when the operation device receives neither the first operation nor the second operation, outputs a standby rotation speed as the command rotation speed, the standby rotation speed being lower than the selected reference rotation speed;

when the operation device receives the first operation, changes the command rotation speed from the standby rotation speed to a first target rotation speed lower than or equal to the selected reference rotation speed in such a manner that as an amount of the first operation increases, an increasing rate of the command rotation speed decreases gradually;

when the operation device receives the second operation, changes the command rotation speed from the standby rotation speed to a second target rotation speed lower than or equal to the selected reference rotation speed in such a manner that as an amount of the second operation increases, the increasing rate of the command rotation speed increases gradually; and feeds the command current to the solenoid proportional valve, such that a discharge flow rate of the pump is proportional to the amount of the first operation and the amount of the second operation.

2. The hydraulic drive system of a construction machine according to claim 1, wherein the actuator is at least one of a boom cylinder, an arm cylinder, and a bucket cylinder.

3. The hydraulic drive system of a construction machine according to claim 2, wherein the second target rotation speed is lower than the first target rotation speed.

4. The hydraulic drive system of a construction machine according to claim 3, wherein the pump controller feeds the command current to the solenoid proportional valve, such that a maximum value of the tilting angle of the pump when the amount of the first operation is at its maximum is the same as a maximum value of the tilting angle of the pump when the amount of the second operation is at its maximum.

5. The hydraulic drive system of a construction machine according to claim 1, wherein the second target rotation speed is lower than the first target rotation speed.

6. The hydraulic drive system of a construction machine according to claim 5, wherein the pump controller feeds the command current to the solenoid proportional valve, such that a maximum value of the tilting angle of the pump when the amount of the first operation is at its maximum is the same as a maximum value of the tilting angle of the pump when the amount of the second operation is at its maximum.

* * * * *